United States Patent [19]

Pace et al.

[11] 3,966,567

[45] June 29, 1976

[54] ELECTROLYSIS PROCESS AND APPARATUS

[75] Inventors: Gerald F. Pace, Casa Grande, Ariz.; John C. Stauter, Arlington Heights, Ill.; Calvin N. Armstrong; Gary R. Harris, both of Ponca City, Okla.

[73] Assignee: Continental Oil Company, Ponca City, Okla.

[22] Filed: Oct. 29, 1974

[21] Appl. No.: 518,842

[52] U.S. Cl. ..... 204/105 R; 204/106; 204/107; 204/108; 204/269; 204/275

[51] Int. Cl.[2] ..... C25C 1/12; C25C 7/00

[58] Field of Search ..... 204/275, 269, DIG. 1, 204/106–108

[56] References Cited

UNITED STATES PATENTS

| | | | |
|---|---|---|---|
| 949,004 | 2/1910 | Ramage | 204/DIG. 1 |
| 1,133,059 | 3/1915 | Perreur-Lloyd | 204/108 |
| 1,314,742 | 9/1919 | Greenawalt | 204/108 |
| 3,503,856 | 3/1970 | Blackmore | 204/23 |
| 3,558,466 | 1/1971 | Lebrizzi et al. | 204/275 |
| 3,876,516 | 4/1975 | Pace et al. | 204/275 |

FOREIGN PATENTS OR APPLICATIONS

| | | | |
|---|---|---|---|
| 29,337 | 10/1930 | Australia | 204/DIG. 1 |
| 270,514 | 5/1927 | United Kingdom | 204/DIG. 1 |

*Primary Examiner*—R. L. Andrews
*Attorney, Agent, or Firm*—Richard W. Collins

[57] ABSTRACT

An improved process and apparatus for electrolysis of a high purity metal from an aqueous pregnant liquor acid electrolyte at high efficiency and high current density in the presence of impurities. In one embodiment the electrolysis cell employed in such process is provided with a fluid cover.

4 Claims, 2 Drawing Figures

ELECTROLYSIS PROCESS AND APPARATUS

BACKGROUND OF THE INVENTION

1. Field of the Invention

The present invention relates to an improved process and apparatus for electrolytic recovery of copper and other materials. In one aspect the invention relates to electrowinning high purity copper from an aqueous liquor, and especially to electrowinning at high efficiency and high current density from a liquor with a low copper concentration in the presence of impurities and gaseous reagents.

2. Brief Description of the Prior Art

Electrolysis of copper has been used as an analytical technique for refining copper and for recovering copper from concentrated solvent in extraction processes. This latter recovery process is related to electrowinning which is the separation of a metal from a solution by electrolysis. Typical electrolytic processes are described in Chemical Abstracts 52-8791G, 66-61198, and 67-78397; in Electrochima Acta, 10, pp. 513–27 (1965) in U.S. Pat. No. 1,133,059 to Perreur-Lloyd; in "Electrolytic Copper Refining," by Eichrodt and Schloen in A. Butts edition of Copper — *The Science and Technolgy of the Metal, Its Alloys and Compounds* ACS Monograph 122, Reinhold Publ. Corp., NY, 1959, and in *Extractive Metallurgy of Copper, Nickel and Cobalt*, Interscience Publ., NY, 1961. These processes generally require high copper concentrations, intermediate purification steps, or low impurity concentration.

Electrolytic recovery has been used to recover copper from copper sulfate-sulfuric acid extraction solvents following acid or salt leaching and extraction purification. With these processes impurities, such as iron, cobalt, molybdenum, certain sulfur compounds and other compounds result in low purity copper. Impurities and low copper concentration result in low purity copper, low efficiency and a current density (i.e., low capacity) process, thereby making electrowinning of such electrolytes impractical.

Various purification or remedial steps have been used to reduce these problems. These steps include use of diaphragm cells, copper cementation, stripping impurities prior to electrolysis, reduction and precipitation of impurities, and combinations of conventional purification steps. None of these remedies have been a cure-all, and each generally results in a complex or expensive addition to a copper recovery process.

Even with these remedial steps, the copper recovered has low purity and must be electrorefined to meet quality specifications such as those set out by ASTM Designations B5-43, B115-43, B170-70, B193-65, B224-70, B216-49, and B442-67 and Part 32 of ASTM standards generally. As used herein and as defined by ASTM, high purity refers to copper analyzing more than 99.95% by weight copper or better than Grade 2 oxygen-free electrolytic copper as set forth in ASTM B170-70. Practically, a purity of about 99.97% copper is required in industry for high purity copper, and Grade 1 copper requires a minimum analaysis of 99.99% copper.

Thus, a need has long been felt in the industry for an electrolytic recovery process and apparatus for recovering and producing high purity metal at high efficiency and low costs and which is operable in electrolytes containing low metal concentrations.

OBJECTS OF THE INVENTION

An object of the present invention is to provide an improved process and apparatus for electrolysis of a high purity metal from an aqueous pregnant liquor acid electrolyte.

Another object of the invention is to provide an improved electrolysis process and apparatus for recovering metals from an aqueous electrolyte medium wherein said metal is of high purity and such process is a high efficiency, low cost process.

Another object of the invention is to provide an improved process wherein an aqueous acid leach pregnant liquor can be employed as the electrolyte without requiring the removal of impurities.

Various other objects, advantages, and features of the invention will become apparent to those skilled in the art from a reading of the disclosure.

BRIEF DESCRIPTION OF THE DRAWING

Drawings accompany and are part of the disclosure. These drawings depict specific embodiments of the apparatus employed in the improved electrolysis process of the present invention, and it is to be understood that the drawings are not to unduly limit the scope of the invention. In the drawing.

In the following discussion and descriptin of the invention, reference will be made to the drawings wherein the same referenced numerals will be used to indicate the same or similar parts and/or structure.

DETAILED DESCRIPTION OF THE INVENTION

Figure 1:
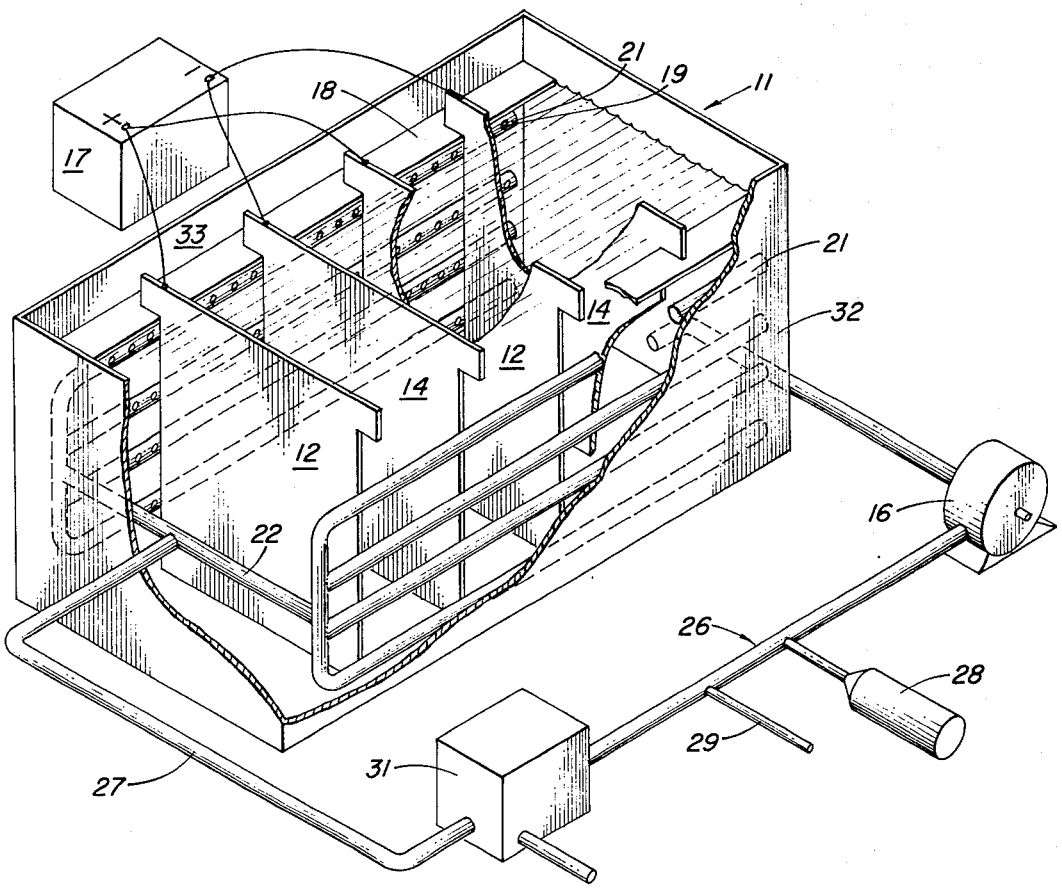
FIG. 1 is a perspective sketch of an electrolysis system showing components in symbolic form.
Figure 2:
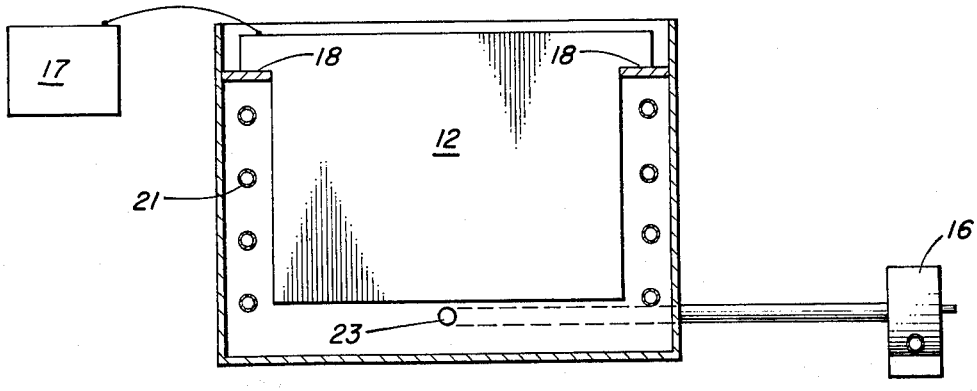
FIG. 2 is a cross-section view of the electrolysis system in FIG. 1.

The improved process and apparatus of the present invention can be used for electrolysis of anions and cations which can be oxidized or reduced by electrolysis in an aqueous electrolyte. This process is especially applicable to electrowinning metals from ores and to the electrolysis of electrolytes including metals such as copper, iron, uranium, silver, zinc, magnanese, cobalt, tin, vanadium, chromium, antimony, aluminum, gold, nickel, platinum, palladium, molybdenum, lead, mercury, and titanium. These metals are in Groups I, II, III, IV, V, VI, VII, and VIII of the periodic table as set forth in the third edition (1950) of Perry's Chemical Engineers' Handbook. Anions which can be used in the process of this invention include those of halogens and halogen compounds, oxides and compounds containing oxygen, sulfides and compounds which contain sulfur, and nitrides and compounds which contain nitrogen. Other anions and cations which can be used in the process of this invention will be apparent to one skilled in the art in view of this disclosure. While any of the material set forth above can be recovered using the process apparatus of the invention, especially desirable results are obtained when such material is copper and the process is a copper electrolysis process.

In order to more clearly define the process and apparatus of the present invention such will be described wherein coherent copper of high purity can be produced with high efficiency from an aqueous pregnant liquor electrolyte containing copper derived from acid leaching a copper ore. Referring now to the drawing, the novel electrolysis system of the present invention will be discussed. Electrolysis cell, 11, which confines the electrolyte in the region of electrodes, 12 and 14, is provided electrolyte circulating means 16, current supply means 17, and electrode holder means 18.

In order to obtain uniform flow of the electrolyte across the faces of electrodes 12 and 14, it is desirable that one control the velocity of the electrolyte discharged through openings 19 of conduit means 21 of circulating means 16 in a range of from about 24 to 54 feet per second. Such is accomplished in the cell designed previously described by controlling the size of openings 19 in conduit means 21, limiting the number of conduit means 21 and by controlling the pressure at which electrolyte is passed through distributor means 22. For example, if one is to obtain the desired uniform agitation of the electrolyte across the face of the electrodes, it is desirable that openings 19 be of a diameter of from about 0.30 to 0.044 inches, the number of conduit means be from about six to 10 per cell, and the pressure at which the electrolyte is circulated through distributor means 22 range from about 40 to 60 psi.

It is important that opening 19 of conduit means 21 be positioned so that same are located between the facing surfaces of electrodes 12 and 14, and, when additional electrodes are employed, between each facing surface of said electrodes. By employing conduit means 21 having such openings 19 therein, one can readily prevent polarization of the electrodes, maintain a substantially constant flow of electrolyte across the entire surface of electrodes 12 and 14, and thus maintain a desired efficiency.

In operation, electrolyte is circulated from electrolysis cell 11 through outlet 23 by circulating means 16 through circulating loop means 26 and into cell 11 through conduit means 27. As electrolyte is pumped from cell 11, additives such as $SO_2$, iron, and any other reagents are injected by means 28 and 29 to adjust and maintain the reagent or additive concentrations in the desired ranges. The temperature is also adjusted by temperature control means 31 in circulation loop means 26 so that the temperature of the electrolyte entering cell 11 is maintained uniform.

The electrodes, 12 and 14, are tee-shaped so that they can readily be supported by electrode holder means 18 and are designed so that about a 3-foot by 3 foot square of such electrodes are immersed in the electrolyte. Electrolysis cell 11 can be fabricated from any suitable non-conductive material. For example, cell 11 can be constructed of steel with a carboline glass liner. Cell 11, a fluid containing cell, is constructed so that vertical sidewalls 32 and 33 are about 4 feet long, about 5 foot high, and spaced about 4 feet apart. Side walls 32 and 33 are designed with electrode holder means 18 for supporting electrode 12, the anode, and electrode 14, the cathode.

Distributor means 22 comprises a plurality of conduit means 21 positioned along vertical sidewalls 32 and 33 of cell 11, said conduit means interconnecting and in fluid communication at one end portion of conduit means 27 of circulating loop means 26. Conduit means 21 is provided with a series of openings 19 positioned between electrodes 12 and 14 so that the electrolyte is caused to flow uniformly across the faces of electrodes 12 and 14 from two opposing directions. Because of the unique design of the electrolysis cell, several critical features must be set forth.

One critical feature of electrolysis cell 11 relates to conduit means 21, especially their position and the agitation of the electrolyte by discharge of circulating electrolyte through openings 19 of said conduit means. If one is to obtain a uniform agitation or sparging action in the before described cell, conduit means 21 must be positioned laterally along walls 32 and 33. In addition, openings 19 of conduit means must be positioned as shown, e.g. so as to be between the electrodes. The electrodes, which are spaced from about 1 to 2 inches apart, are connected to a DC electric current supply means 17 so that an electric voltage can be impressed between electrodes 12 and 14 through electrolyte in cell 11. When more than two electrodes are employed, it is preferred that the electrodes at each end of the cell be anodes with cathodes and anodes alternating insequence along the tank.

A unique feature of the process employing the electrolysis cell previously described relates to the composition and temperature of the electrolyte. A residual concentration of sulfur dioxide ($SO_2$) is essential; this residual concentration should be at least about 0.01 g/l in the electrolysis cell as indicated by any standard test method. A potentiometric titration method is preferred using calomel and platinum electrodes with a potential of about -75° millivolts (mv) as the end point to indicate $SO_2$ concentration. Optimum concentration for a particular system can be readily determined and maintained with minimum experimentation by one skilled in the art in view of this disclosure.

The $SO_2$ concentration of the electrolyte can be controlled by several methods. With the preferred external loop, $SO_2$ can be injected into the electrolyte practically anywhere in the loop. The $SO_2$ can be a gas, a liquid or dissolved in electrolyte stored in a reservoir. Electrolyte can be analyzed to determine the $SO_2$ concentration and $SO_2$ concentration adjusted accordingly. With minimum experimentation in view of this disclosure, one skilled in the art can predict the rate of $SO_2$ consumption and add $SO_2$ accordingly with very few actual tests. The $SO_2$ consumption can also be predicted in view of this disclosure with minimum experimentation by monitoring other process rates, e.g. electrical power consumption, electrowinning time, etc. The other chemical reagents used in electrowinning and even the concentration of iron used in a preferred process can be controlled by these methods; although, as with iron, the reagent may not be consumed directly by electrowinning. The process produces sulfuric acid which can be recycled to an ore leaching operation.

In a preferred process, an iron concentration of at least 3.0 g/l is maintained in the electrolyte. High iron concentration makes possible high current density. Most "pregnant liquor" electrolytes contain iron, but iron can be adjusted to maintain the desired iron concentration in the electrolyte if needed or desired.

Pregnant liquor as used herein refers to an electrolyte containing copper ions which has been derived from acid leaching a copper ore. Generally, this leach liquor must be processed by selective extraction or chemical purification to remove the impurities such as iron, aluminum, and molybdenum. With the process of this invention complete, removal of all of these other metals is not essential.

The electrolyte used in the process of this invention are aqueous acidic electrolytes. As used herein, aqueous means that the electrolyte contains a substantial portion of water. Organic, inorganic, or non-aqueous components can also be present. These aqueous electrolytes are preferably acidic and can contain about 5–100 grams per liter (g/l) of acid. More or less, acid can be used, and the process of this invention is practical with low acid electrolytes. An acid concentration of about at least 5 g/l is preferred. Sulfuric acid is the acid normally used for the electrolyte, and it is the acid preferred for this invention. Salts and acids other than sulfuric can be in the electrolyte as long as they do not interfere with the electrowinning process. These acids include mineral acids such as HCl, $H_3PO_4$, H $NO_3$ etc. and organic acids such as acetic, oxalic, etc. These acids and salts can be used as a buffer, to prevent side reactions or for other purposes not directly related to electrowinning. With sulfuric acid, 2 moles of sulfuric acid are produced for each mole of copper recovered at the cathode where prior art process only produced 1 mole of acid. Thus, the process of this invention produces twice as much sulfuric acid and consumes $SO_2$ which is normally in air polluting byproduct of sulfide ore processing.

Temperature of the electrolyte of the process of this invention must be maintained above about at least 70°F and preferably in the range of about 100°–150°F. Electrolysis efficiency of this process is higher at temperatures near the top of this temperature range.

Components other than those pointed out herein can be present in the electrolyte. Most of the components encountered in acid leaching sulfide copper ores can be tolerated and do not interfere in the process. Unusual components which interfere with $SO_2$, iron, or electrolysis can be readily identified in view of this disclosure and must be removed or inhibited.

The source and control of electrical current for electrolysis are conventional with the process of this invention; however, lower voltage can be used than with prior art processes. A voltage sufficient to deposit copper at the cathode or reduce copper ion to atomic copper is required. With this process, the minimum practical voltage is about at least 0.4 volts. Voltage in the range of about 0.5–1.5 volts is preferred. The maximum permissible voltage is determined by impurities and side reactions. For instance, high voltage which causes evolution of oxygen at the anode, evolution of hydrogen at the cathode, formation of copper sulfide, or other undersirable side reactions should be avoided. Chemical component polariztion or localized high concentration contribute to these problems; for example, high acid concentration accentuates hydrogen evolution although high acid concentration aids use of high current density. Whether steady direct current (D.C.), pulsating D.C., or any other current form is used, the voltage should be near the optimum range to avoid reduction of other cations. The voltage is preferably maintained substantially constant although it can be adjusted for various electrolytes. for a preferred process current densities of over 40 amperes per square foot of cathode area (amp./ft.$^2$) can be obtained with less than 1.5 volts and an electrolyte having about 10 g/l sulfuric acid and less than 10 g/l copper. Electrode number and spacing are conventional, and optimum values can be readily determined by one skilled in the art in view of this disclosure, and the total electrolysis rate desired. High electrolysis rate can result in electrical polarization or formation of a high electrical resistance barrier which, in effect, lower the effective voltage driving the electrolysis. Likewise, high reaction rate and inadequate agitation can result in chemical polarization or high and low concentration of components required for electrolysis. Polarization should be avoided and can generally be reduced by increasing agitation of the electrolyte. The $SO_2$-iron combination of this invention makes it practical to use less expensive materials, such as carbon, for electrodes because oxygen is not involved and prevents oxygen contamination of deposited copper.

Copper deposited at the cathode is high purity copper which normally adheres to the cathode. With starting cathodes of copper, the entire cathode is copper. If carbon or other material is used, removal of the copper from the cathode will be required to recover only copper. If the copper does not adhere to the cathode, it can be recovered from the electrolyte by conventional methods such as sedimentation or filtration. With the process of this invention, copper having a purity higher than about 99.95 percent by weight can be recovered from electrolyte having less than about 10 g/l copper at an efficiency of better than about 70 percent with recovery of more than about 95 percent of the copper or down to a concentration of about 0.5 g/l. As used herein efficiency refers to the percent of electrical current which actually reduces copper ion at the cathode. Thus, the process of this invention provides a practical process for recovering copper in high purity with high current density and efficiency in the presence of impurities even at copper concentrations which have previously been too low for practical recovery.

In many electrolysis process one is faced with loss of electrolyte, such being due to evaporation and the like. When employing the electrolysis cell and process of the present invention one may encounter such a loss of electrolyte. When such a loss is encountered, future loss can be prevented by covering the electrolyte in the electrolysis cell with an inert liquid which is non-conductive and immiscible with the electrolyte. The liquid can contain additives of fillers such as inert spheres, viscosity modifiers, volatility reducers, etc. to reduce the amount of fluid used or to modify fluid properties for any purpose which will be apparent or conventional in view of this disclosure. For instance, inert spheres of glass or rubber can be added to the fluid to reduce the amount of fluid required and to reduce splashing of electrolyte and fluid cover. The liquid can have a specific gravity greater than the electrolyte if the surface tension is sufficient to keep the covering fluid on top of the electrolyte. Liquids having a specific gravity lower than that of the electrolyte are preferred to avoid problems with emulsions of the liquid and electrolyte or with inversion of the liquid and electrolyte. Preferred liquids have a specific gravity less than about 1.25. A significant difference is also preferred between the specific gravities of the liquid and electrolyte to reduce the tendency to form a stable emulsion. The ratio of specific gravities of covering liquid in electrolyte is preferably less than about 1.10 . Additives can be used to increase surface tension or to decrease the tendency to form emulsions to reduce problems with emulsions. Formation of an emulsion should not adversely affect the electrolysis process except more liquid will be required to make up loss liquid and in some cases the liquid may wet or coat electrodes or other electrolysis equipment and have an indirect adverse effect. The liquid can contain additives which do not substantially adversely affect the electrolysis process, but some adverse effect such as slight conductivity can be tolerated under some circumstances.

Preferred liquids for the process of this invention are hydrocarbon oils, substituted hydrocarbon oils, or hydrocarbon-based oils. These oils are substantially an aliphatic hydrocarbon which do not have any substantial percent of unsaturated groups, chemically reactive groups, or electrically reactive groups. The liquids include refined hydrocarbon fractions such as gasoline, kerosene, fuel oil, bunker oil, naphtha, gas oil, lube oil, a residuum fraction, diesel oil, a paraffin wax fraction, reduced crude, mineral oil, silicone oil, halogenated oil, and certain crude oils. Liquids having high volatility such as gasoline are not preferred for safety reasons but may be used in some circumstances. In other words, the liquid should have a flash point greater than about 30°F as determined by ASTM Methods D92 or D56. The liquid preferably has a relative viscosity of at least about 0.5 as compared to water. A viscosity of at least about 100 seconds Saybolt Universal (SSU) at about 100°F as determined by ASTM Method D88 is preferred. Materials which are normally solid at atmospheric conditions or about 25°C such as paraffin wax can be used in some circumstances. A normally solid fluid can be melted so that it can be poured onto the electrolyte, and the fluid can then be maintained at a temperature to keep it liquid or it can be allowed to solidify and heated when it is to be removed or when equipment must be removed from the electrolyte.

The liquid cover is preferably added to the electrolysis tank after the equipment is assembled to avoid problems of coating or contaminating equipment with the liquid. By pre-wetting the equipment with water, with electrolyte, with soapy water, or water with other additives, it can pass through the liquid without damaging the equipment or coating the equipment with the liquid. This procedure can be used even for metallic electrodes such as copper electrodes or for carbon electrodes with mineral oil as the tank covering fluid. Even with this procedure, the oil is preferably removed first or added last when it is necessary to remosve several electrodes or pieces of equipment from the electrolysis tank.

While the foregoing discussion and description has been made in connection with certain preferred specific embodiments of the improved electrolysis and apparatus of the present invention, it is to be understood that minor variations can be made in the process and apparatus without departing from the spirit of the invention. Thus, it is to be understood that the discussion and description is only intended to illustrate and teach those skilled in the art how to practice the invention, and such is not to unduly limit the scope of the invention which is defined in the claims set forth hereinafter.

Having thus described the invention, we claim:

1. An improved apparatus for electrolyzing ions in an aqueous electrolyte comprising an electrolysis cell containing said electrolyte; electrodes immersed in said electrolyte, said electrodes being at least one anode and at least one cathode; a current supply means connected to said electrodes for supplying an electrical direct current to said electrodes and impressing said current through said electrolyte; an electrolyte circulating means fluidly communicating with said cell; a reagent injection means and a temperature control means fluidly communicating with said electrolyte circulating means; and, electrolyte distributor means secured to two parallel side portions of said cell and fluidly communicating with said circulating means so that electrolyte distributed therethrough is directed across the face of said electrodes from two opposing directions, said electrolyte distributor means comprising a plurality of horizontally disposed conduit means each having a plurality of openings therein having a diameter of from 0.30 to 0.044 inches.

2. In a process for electrolyzing ions by which a metal of high purity can be produced with high efficiency from an aqueous pregnant liquor electrolyte, the improvement comprising circulating said electrolyte between at least one cathode and at least one anode immersed in said electrolyte from two opposing directions at a discharge velocity of from 24 to 54 feet per second; maintaining an electrical voltage differential between said anode and cathode of at least 0.4 volts; maintaining the temperature of the electrolyte at about 70°F; and, recovering a coherent high-purity metal product at the cathode.

3. The process of claim 2 which includes a low conductivity immiscible fluid covering said electrolyte to prevent exposure of said electrolyte to a reactive atmosphere.

4. The process of claim 3 wherein said immiscible fluid is a hydrocarbon having low volatibility.

* * * * *